United States Patent [19]

Tiefenbrun

[11] 4,008,374

[45] Feb. 15, 1977

[54] LOUDSPEAKER SYSTEMS

[76] Inventor: Ivor S. Tiefenbrun, 1 Castle Court, Broomhill Ave., Newton Mearns, Renfrewshire, Scotland

[22] Filed: Jan. 21, 1975

[21] Appl. No.: 542,821

[30] Foreign Application Priority Data

Jan. 26, 1974 United Kingdom ..... 03726/74

[52] U.S. Cl. ..... 179/1 E; 181/146

[51] Int. Cl.[2] ..... H04R 1/28

[58] Field of Search ..... 179/1 E, 1 GA, 111, 179/115.5 PS, 115.5 DV; 181/144, 145, 146, 147, 31 B

[56] References Cited

UNITED STATES PATENTS

| | | | |
|---|---|---|---|
| 2,496,589 | 2/1950 | Marquis | 179/115.5 PS |
| 2,768,702 | 10/1956 | Lowry | 179/1 E |
| 2,922,849 | 1/1960 | Uchida | 179/115.5 DV |
| 2,993,091 | 7/1961 | Guss | 179/1 E |
| 3,022,377 | 2/1962 | Bobb et al. | 179/1 E |
| 3,202,773 | 8/1965 | Tichy | 181/147 |

*Primary Examiner*—Kathleen H. Claffy
*Assistant Examiner*—Joseph Popek
*Attorney, Agent, or Firm*—Mason, Fenwick & Lawrence

[57] ABSTRACT

A bass unit for a loudspeaker system which has a pair of loudspeakers mounted one behind the other in a casing to define a chamber of air therebetween. The loudspeakers are operated in phase with one another so that the pressure of air in the chamber remains substantially constant and the loudspeaker which is mounted on a front wall of the cabinet thus operates under substantially "ideal" conditions. Any changes in sound pressure within the chamber represent distortion components and are absorbed by a curtain of absorbent material in the chamber by a filling of absorbent material.

6 Claims, 3 Drawing Figures

LOUDSPEAKER SYSTEMS

This invention relates to a bass unit for a loudspeaker system.

Conventional loudspeaker systems, for example, sealed box, infinite baffle, horn, electrostatic, bass reflex, and transmission line systems all employ a loudspeaker or a membrane to produce frequencies including bass frequencies. The loudspeaker or membrane will normally have a much lower resonant frequency in free air than in an enclosure, for example, a bass driver may have a free air resonance at about 20 Hz but in an enclosure its resonance would occur at typically 25 – 35 Hz or higher. This raising of the loudspeaker resonance results in a peak in the loudspeaker system response curve resulting in "booming" and other undesirable resonance effects within the audible spectrum.

Furthermore, in order to reproduce audible frequencies, and especially bass frequencies, most loudspeaker systems employ a fixed mass of air enclosed or restricted behind the driver. This means that the driver is constantly compressing and rarifying this restricted mass of air which has the effect of causing colouration and distortion in the sound produced. A bass reflex cabinet attempts to overcome this problem but the reflex action is found to only occur at around one frequency. This disadvantage is usually employed with a cabinet resonance to boost the bass response by the use of reflected anti-phase sound at a particular frequency in order that it emerges in phase. In common with other systems the response, especially the bass response, is neither as undistorted, uncoloured or as extensive as the original sound to be reproduced.

It is an object of the present invention to obviate or mitigate the disadvantages outlined above.

According to the present invention there is provided a bass unit for a loudspeaker system comprising a casing, a first bass loudspeaker having front and rear faces, said first bass loudspeaker being so mounted in the casing that the front face of the said first bass loudspeaker faces outwardly of the casing, a second bass loudspeaker having front and rear faces, said second bass loudspeaker being mounted in the casing behind said first loudspeaker with its front face opposite the rear face of said first loudspeaker so as to define between said first and second loudspeaker a chamber of air, operating means for operating said first and second loudspeaker in phase such that the pressure of air in the chamber remains substantially constant, and sound absorbing means located in said chamber to absorb distortion components resulting from different response characteristics of said first and said second loudspeakers.

Further according to the present invention there is provided a bass unit for a loudspeaker system comprising a housing having a rear wall, a permanent magnet assembly mounted in said housing on said rear wall and having a central core, two sound radiating surfaces defining therebetween a chamber of air and each sound radiating surface being located around said central core, and operating means for independently driving said sound radiating surfaces in phase such that the pressure of air in the chamber remains substantially constant, and sound absorbing means located in said chamber to absorb distortion components resulting from different response characteristics of said first and said second loudspeakers.

Embodiments of the present invention will now be described by way of example with reference to the accompanying drawings, in which.

Figure 1:
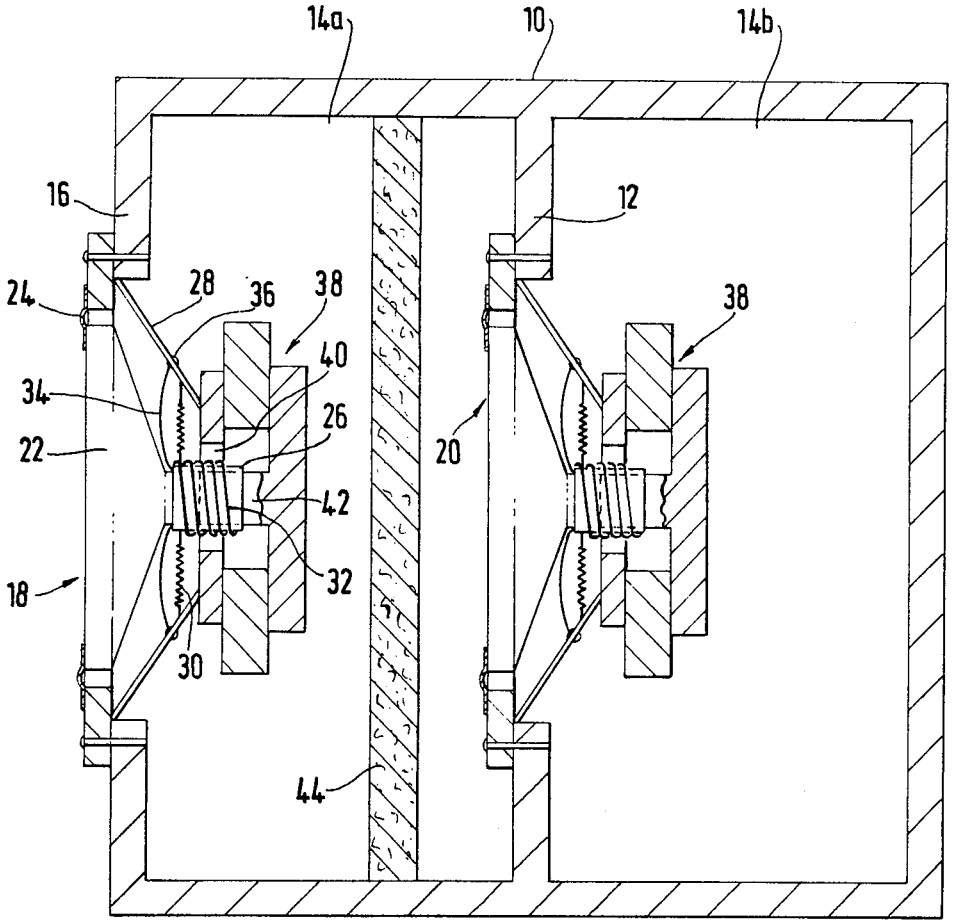
FIG. 1 is a section through a loudspeaker cabinet mounting a bass unit according to the invention.

Referring to FIG. 1 of the drawings, a bass unit for a loudspeaker system which allows a sound producing bass driver to behave virtually as if it were in free air, i.e. independently of a cabinet housing the driver, while at the same time producing substantially no anti-phase sound, includes a cabinet 10 having an internal partition 12 defining chambers 14*a*, 14*b*. Mounted within the chamber 14*a* on a front wall 16 of the cabinet 10 is a front bass driver 18, and mounted within the chamber 14*b* on the partition 12 behind the driver 18, is a rear bass driver 20. Each driver 18, 20 includes a conical diaphragm 22, the front face of which is mounted by means of a resilient surround 24 on a chassis 28 which, in turn, is mounted on the respective wall 16 and partition 12. A cylindrical hollow former 26 extends axially outwards from the apex of the diaphragm 22 and is mounted on the chassis 28 by a resilient suspension 30. A coil 32 is wound on the former 26 and has leads 34 connecting to terminals 36 on the chassis 28. Audio-frequency signals from an amplifier (not shown) are fed to the coil 32 through the terminals 36.

A permanent magnet assembly 38 is secured to the chassis 28 and defines an annular flux gap 40 with a cylindrical central core 42. The magnet assembly 38 and the coil 32 are mounted relative to each other such that the coil 32 is disposed within the flux gap 40, the core 42 of the magnet assembly 38 extending into the hollow former 26.

In operation, the audio-frequency signals from the amplifier cause the coil 32 to set up a magnetic field which interacts with the magnetic field of the permanent magnet and causes the coil 32 and the diaphragm 22 to move.

The rear surface of the front bass driver 18 is linked to the front surface of the rear bass driver 20 by an enclosure of air in the chamber 14*a*. Both bass drivers 18, 20 are driven independently but in phase, with the result that substantially no sound pressure is produced within the chamber 14*a* and for this reason the effect will be hereinafter referred to as the "ISOBARIC" Effect and the chamber will be hereinafter referred to as the "ISOBARIC" Chamber. Consequently the front bass driver 18 is mounted in the cabinet 10 under "ideal" conditions. The rear chamber may be a sealed enclosure, transmission line, labyrinth or reflex cabinet, it being most desirable to use a sealed enclosure or infinite baffle since the response of the front driver 18 can be almost perfect or as good as is theoretically possible. A filling of absorbent material may be provided in the chamber 14*b*.

The rear driver 20 is mounted at a distance from the front driver 18 considerably less than half the wavelength of the highest frequency to be produced by the drivers in order that little or no phase shift cancellation effects be produced. In view of the physical dimensions of the loudspeakers, it is not possible to space the front and rear drivers apart by a distance less than half the wavelength corresponding to a frequency of about 500 – 600 Hz. It is possible to tailor the frequency response of the drivers 18, 20 by separating them by a distance which, in conjunction with the natural roll off of the loudspeaker at the upper limit of its response, will, by virtue of the phase cancellation effects induced, enable the elimination of the cross over network or a reduction in the complexity of the cross over network.

Any distortion components, which the rear driver 20 produces from its front face will constitute virtually the only sound pressure in the "Isobaric" Chamber and in accordance with the object of the invention this is absorbed by conventional acoustic means such as a curtain 44 of absorbent material. Alternatively, a filling of absorbent material is provided in the "Isobaric" Chamber.

Several practical limitations apply to the above described loudspeaker system, for example, the bass drivers must not be too close together or the magnetic fields may interact unfavourably; each chamber may require a vent to atmosphere, either directly or indirectly, to neutralise unequal effects resulting from pressure changes brought about by temperature or atmospheric changes; and normal considerations of cabinet rigidity and internal damping and absorption apply as in any other loudspeaker system.

It is envisaged using this arrangement of bass drivers with normal mid range and treble units, or with a combined mid range/treble unit. Furthermore, it is possible to utilise additional treble and mid range units or one combined unit pointing in another direction to give the total enclosure omnidirectional characteristics.

Figure 2:
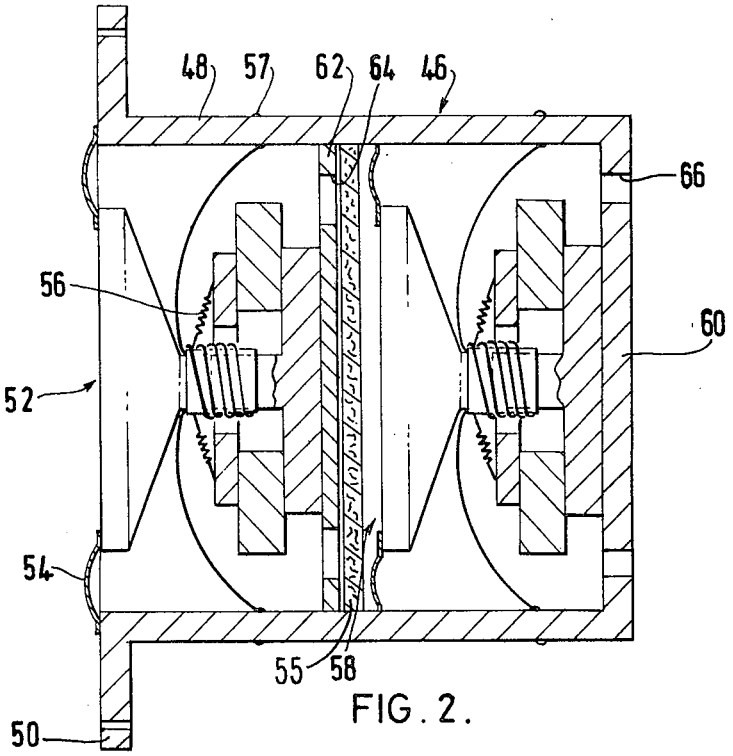
FIG. 2 is a section through a modified bass unit for mounting in a cabinet.

In a modification as shown in FIG. 2, a unit 46 is provided which comprises a housing 48 adapted to be mounted in a cabinet (not shown) by means of a mounting flange 50. A front bass driver 52, having similar components, and operating in a similar fashion to the drivers 18 and 20 described hereinbefore, is mounted by means of a resilient surround 54 directly on the front of the housing 48. By virtue of there being no chassis provided, a resilient suspension 56 for the former is mounted on the magnet assembly and the leads from the coil are connected to terminals 57 provided externally on the housing 48.

A rear bass driver 58 identical to the front driver 52 is mounted within the housing 48 and its permanent magnet assembly engages against a rear wall 60 of the housing 48. A supporting spider 62 is mounted in the housing 48 intermediate of the drivers 52, 58 and has openings 64 defined therein. The rear wall 58 also has openings 66.

The "Isobaric" Chamber is defined between the drivers 52, 58 and is provided with an absorbent curtain 55 or is filled with absorbent material.

Figure 3:
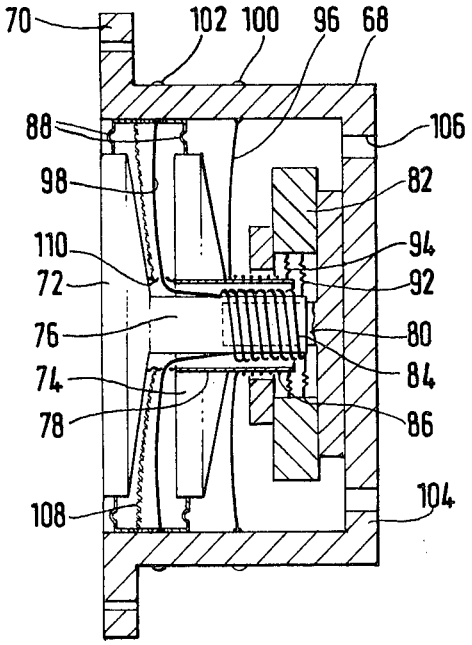
FIG. 3 is a section through another embodiment of a bass unit for mounting in a cabinet.

Referring to FIG. 3, a housing 68 with an annular flange 70 for mounting on a cabinet (not shown) mounts two cones 72, 74 driven independently of one another. The cones 72, 74 have formers 76, 78 located around a common central core 80 of a permanent magnet assembly 82, coils 84, 86 being wound on the respective formers 76, 78.

The cones 72, 74 are mounted on the housing by means of a resilient suspension 88 and the formers 76, 78 are mounted on the magnet assembly 82 by suspensions 92, 94. Leads 96, 98 from the coils 92, 94 connect with terminals 100, 102 mounted externally on the housing 68. The magnet assembly 82 is supported on a rear wall 104 of the housing 68, the latter being provided with openings 106.

The "Isobaric" Chamber is defined between the cones 72, 74 and is provided with an absorbent curtain 108. Alternatively the chamber is provided with an absorbent filling, a seal 110 extending between the cones 72, 74.

It should be appreciated that flat sound radiators or radiators of other shapes can be utilized in place of conical diaphragms.

During operation, the rear bass driver is assisted in its work of compressing and rarifying the air in the "Isobaric" Chamber to some extent by the front bass driver.

Virtually all of the output from the rear bass driver is absorbed in creating "ideal" conditions for the front driver. The resultant effect is the production of pure undistorted sound which is extended downwards to the free air resonance of the front bass drivers and to even below that level. The sound is also virtually free from colouration and anti-phase effects. The full potential of the above-described system is realised when the relative sizes of the various chambers are optimised. This takes into account the separation of the relative resonances of the chambers as well as the sizes and characteristics of the units employed. An additional advantage of the system is that it enables with minimum compromise "realistic and clean" bass sound from a cabinet very much smaller than that which would normally be required to even remotely approximate the purity and clarity of the sound produced by employing the "Isobaric" Effect.

The salient feature of the above-described system is that the bass drivers respond in such a way as to maintain the "Isobaric" Chamber free from sound pressure and it is conceivable that this can be done with dissimilar bass drivers or by specially built composite loudspeakers built for this purpose. In this way the front bass driver can perform under ideal conditions which optimise its performance capabilites.

I claim:

1. A bass unit for a loudspeaker system comprising a casing, a first bass loudspeaker having front and rear faces, said first bass loudspeaker being so mounted in the casing that the front face of the said first bass loudspeaker faces outwardly of the casing, a second bass loudspeaker having front and rear faces, said second bass loudspeaker being mounted in the casing behind said first loudspeaker with its front face opposite the rear face of said first loudspeaker so as to define between said first and second loudspeakers a chamber of air, operating means for operating said first and second loudspeakers in phase such that the pressure of air in the chamber remains substantially constant, and a sound absorbing curtain located in said chamber between the rear face of said first bass loudspeaker and the front face of said second bass loudspeaker and arranged parallel to said faces to absorb distortion components resulting from different response characteristics of said first and second loudspeakers.

2. A bass unit according to claim 1, wherein the casing includes an internal partition and a front wall, said first speaker being mounted on said front wall and said second speaker being mounted on said internal partition.

3. A bass unit according to claim 1, wherein the loudspeakers are spaced apart by a distance less than half the wavelength of the highest frequency to be produced by the speakers.

4. A bass unit for a loudspeaker system comprising a housing having a rear wall, a permanent magnet assembly mounted in said housing on said rear wall and having a central core, two sound radiating surfaces defining therebetween a chamber of air and each sound radiating surface being located around said central core, operating means for independently driving said sound radiating surfaces in phase such that the pressure of air in the chamber remains substantially constant, and a sound absorbing curtain located in said chamber between the rear face of said first bass loudspeaker and the front face of said second bass leadspeaker and arranged parallel to said faces to absorb distortion components resulting from different response characteristics of said first and second loudspeakers.

5. A bass unit according to claim 4, wherein said sound radiating surfaces include supports located on said central core and said operating means comprises separate coils wound on the supports of the respective sound radiating surfaces.

6. A bass unit according to claim 4, including means in said rear wall of the housing defining openings to atmosphere.

* * * * *